United States Patent [19]

Hiller et al.

[11] 4,442,645

[45] Apr. 17, 1984

[54] CONSTRUCTION PANEL FOR DOUBLE FLOORS IN AIR CONDITIONED ROOMS

[75] Inventors: Wolfgang Hiller, Karlstadt/Laudenbach; Hans Kramer, Mainbernheim, both of Fed. Rep. of Germany

[73] Assignee: MERO-Werke Dr.-Ing. Max Mengeringhausen GmbH & Co., Wurzburg, Fed. Rep. of Germany

[21] Appl. No.: 204,352

[22] Filed: Nov. 5, 1980

[30] Foreign Application Priority Data

Nov. 7, 1979 [DE] Fed. Rep. of Germany ..... 2944842

[51] Int. Cl.[3] ..... E04D 29/14

[52] U.S. Cl. ..... 52/221; 220/3.3; 404/26

[58] Field of Search ..... 52/19, 20, 21, 221, 52/220, 802, 811; 404/24, 25, 26; 220/3.94, 3.3, 4 R, 6

[56] References Cited

U.S. PATENT DOCUMENTS

| | | | |
|---|---|---|---|
| 469,501 | 2/1892 | Fowler | 404/25 |
| 2,297,179 | 9/1942 | Walker | 52/221 |
| 3,494,651 | 2/1970 | Fork | 52/221 |
| 3,844,073 | 10/1974 | Peletz | 52/20 |

FOREIGN PATENT DOCUMENTS

| | | | |
|---|---|---|---|
| 2166319 | 10/1973 | Fed. Rep. of Germany | 52/221 |
| 1080858 | 12/1954 | France | 404/25 |
| 708572 | 1/1966 | Italy | 52/20 |
| 24770 | of 1894 | United Kingdom | 405/25 |
| 203230 | 9/1923 | United Kingdom | 404/25 |

*Primary Examiner*—Henry E. Raduazo

*Attorney, Agent, or Firm*—Jacobi, Siegel, Presta, Marzullo & Aronson

[57] ABSTRACT

A compound construction panel for double floors used in room air conditioning, comprising an external, tub-shaped sheath formed of a high tensile-strength and high Young's modulus material, a filler in the sheath formed of a low tensile strength and low Young's modulus material, and a rigid annular body disposed in an aperture in the bottom of the sheath and extending to the upper portion of the sheath. The annular body is anchored in the filler and is provided with a radially inwardly projecting annular flange at its lower portion which serves as a support for an air discharge nozzle, a dirt-catcher or the like.

3 Claims, 5 Drawing Figures

CONSTRUCTION PANEL FOR DOUBLE FLOORS IN AIR CONDITIONED ROOMS

BACKGROUND OF THE INVENTION

The invention relates to an overhanging compound construction panel for double floors used in air conditioning applications to rooms, comprising an external tub-shaped sheath made from a high tensile-strength and high Young's modulus material, for instance, sheet metal or plate steel, and a hardened filler material positioned in the flowing or pourable state in this tub-shaped sheath and of a minor tensile-strength and minor Young's modulus, for instance, anhydrite.

Such a compound panel is known from the German Pat. No. 2,004,101. This panel is especially characterized by high static strength at a relatively minor thickness, but furthermore it is also combustion-proof and acoustically very advantageous, so that it is especially suited to the manufacture of high-grade double floors.

In recent times, double floors have been increasingly used in relation to room air conditioning, the conditioned air being directly introduced through the space between the double floor and a solid or raw ceiling or through ducts by means of apertures in several selected double-floor panels into the room to be air conditioned. Air-discharge means, so-called spin nozzles, together with a dirt-catching means or the like underneath each are integrated in these orifices in the double floors. To date, the mounting of these air discharge nozzles with associated dirt-catchers was implemented solely in double floors made of wood or steel. Where double floors made from compound panels as initially described are concerned, special steel plates have been used for room air conditioning purposes wherein are contained the air discharge nozzles with dirt-catchers. The integration of nozzles and dirt catchers in these compound panels presents some difficulties as these panels are of relatively low height and therefore one or more cut-outs in them will excessively reduce their mechanical strength. Account must be made in this respect that where such double floors are used, for instance, in offices or computer facilities, they are subjected to very substantial loads of several tons, even to point loading. On the other hand, the use of special steel plates in double floors is both uneconomical and acoustically disadvantageous.

SUMMARY OF THE INVENTION

It is therefore the object of the present invention to eliminate the above drawbacks and to so further develop a compound panel of the above-described kind that it can be equipped with one or more air discharge nozzles and associated dirt catchers without thereby degrading its mechanical strength and while retaining its previous highly economical production process, for the purpose of manufacturing double floors suitable for air conditioning which consist exclusively of compound panels of the above-described type.

This object is obtained by an overhanging compound construction panel which is characterized by the invention by comprising at least one rigid annular body anchored in the filler means and mounted solidly in an orifice in the bottom of the tub-shaped sheath in a substantially sealed manner, and extending to the upper side of the compound panel and provided with radially inwardly projecting segments of an annular flange or with annular flange segments or similar projection means which can be reduced in height for adjusting to tolerance and which act as a support means for an air discharge nozzle and dirt catcher or the like known per se. This annular body advantageously can be fastened, prior to the introduction of the flowing or pourable filler materials, to the bottom of the tub-shaped sheath, e.g., by means of sheet metal screws and, as the annular body extends to the upper side of the compound panel, it will provide a space above the opening in the bottom of the tub-shaped sheath during the ensuing introduction of the filler material, the clear space then receiving the air discharge nozzle and the fastening flange for a dirt catcher. Once the filler material hardens, the annular body already fixed to the sheath will be solidly anchored within it, whereby the static parameters of the compound panel will practically correspond to those of a continuous compound panel of this design. Accordingly, the compound panel of this invention will withstand the highest point loads, as might occur for instance in computer facilities through the feet of the equipment. The required alignment of the upper edge of the annular body with the upper side of the hardened filler material is implemented in accordance with one variation of the invention in a simple manner by grinding the annular body simultaneously when grinding off the filler material, whereby the annular body shall always be flush with the upper side of the filler material.

Even though the compound panels of the above-discussed type may vary slightly in height, i.e., thickness on account of manufacturing procedures, a projection of the air discharge nozzle can advantageously be avoided by correspondingly reducing its support means, for instance by turning or grinding, until the upper side of the air discharge nozzle is flush with that of the compound panel. This is especially significant when the walk-on covering of the compound panel consists of a material of small height and of relatively high density, for instance needle felt, or even when plastic plates, ceramic or stone are used for such coverings. Any high strength metal or plastic can practically be used as the annular body material; however, for reasons of easier workability, an aluminum alloy in conjunction with anhydrite is preferred, as the filler material thoroughly bonds with the outside of the annular body (the liquid anhydrite slightly etches the aluminum material).

Any height tolerance adjustment required when installing an air discharge nozzle and a dirt catcher in the annular body will be facilitated if, in conformity with an embodiment of the invention, an upper part of the annular flange or annular flange segments acting as a support is or are separated by an annular groove or annular groove segments, respectively, from a cylindrical inside wall of that annular body. Such an annular groove or annular groove segments simplify the tool adjustment or guidance for removing the material from the annular flange or annular flange segments. A further embodiment of the invention also helps in this respect, by means of which the inside cross-section of the annular groove or annular groove segments may flare inward and upwardly in a trapezoidal manner.

In yet another embodiment of this invention, the annular body anchored in the filler is provided with at least one outwardly radially projecting annular flange or several annular flange segments or similar projecting means.

BRIEF DESCRIPTION OF THE DRAWINGS

The invention is further discussed below in relation to the drawings of illustrative embodiments.

DESCRIPTION OF THE PREFERRED EMBODIMENTS

Figure 1:
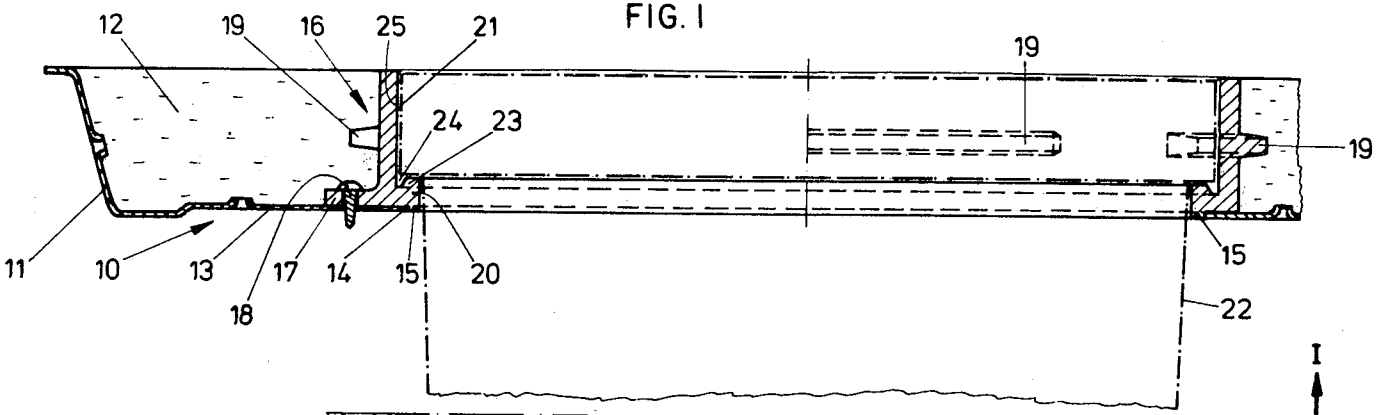
FIG. 1 is a side elevational view in partial cross-section of a compound construction panel with the annular body of the invention for fastening an air discharge nozzle and a dirt catcher, which are indicated in dot-dash lines along the section line I—I of FIG. 2.
Figure 2:
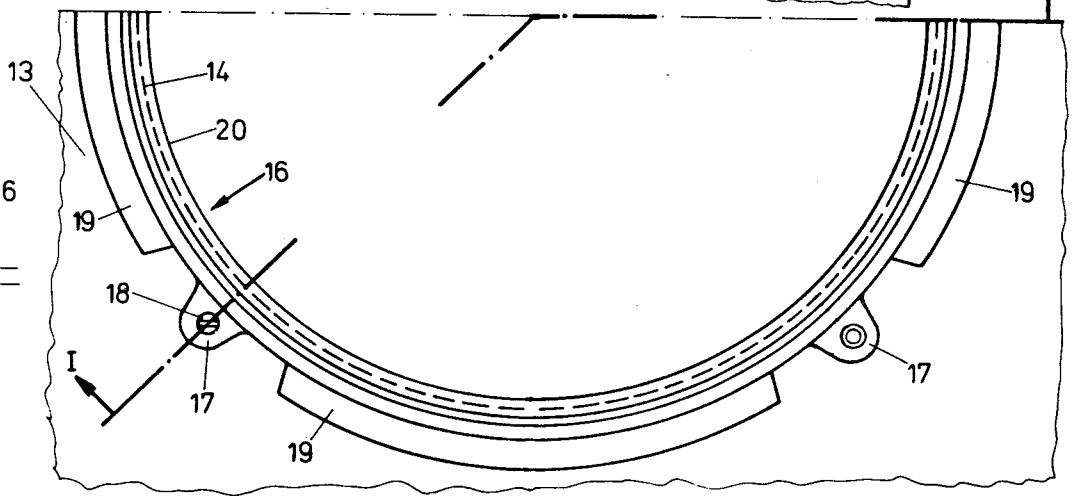
FIG. 2 is a partial plan view of the panel shown in FIG. 1.

FIG. 1 shows an overhung compound construction panel 10 comprising an external, tub-shaped, high-tensile strength sheath 11, for instance, of galvanized steel, and a filler means 12, for instance, of anhydrite, that is introduced in flowable or pourable condition into the tub-shaped sheath 11, where it hardens. Compound panels of this design are propped at their corners on feet (not shown) and butt against one another by their edges, so as to form a double floor. Each compound panel 10, furthermore, is provided on its upper side with a walk-on covering, for instance, carpeting or plastic, stone or ceramic plates. The joints between the individual compound panels can be sealed in any known manner.

In order to integrate double floors made from such compound panels into air conditioning, several selected panels must be provided with passages through which the conditioned air can flow from the space below the double floor into the room to be conditioned. A compound panel with such a passage means is shown in partial section in FIG. 1. To that end, a circular orifice 14 is provided, for instance, by stamping the bottom 13 of the tub-shaped sheath 11, and an annular body 16 of a high-strength material such as an aluminum alloy, and comprising an annular collar 15, is seated in a tight-fitting manner in the aperture 14. Several radially outwardly extending fastening eyes 17 with bores are provided at the lower or upper sides of the annular body 16, through which pass the sheet metal screws 18 by means of which the annular body 16 is fixed to the bottom 13 of the tub-shaped sheathing 13. The filler 12, for instance, anhydrite, is introduced in the liquid state into the tub-shaped sheath 11 after the annular body 16 is solidly and essentially hermetically joined to the bottom 13 of the sheath 11.

Four radially projecting annular flange segments 19 located in substantially the same plane are provided in the annular body 16 to anchor it in the filler 12 in this embodiment.

The annular body 16 further comprises, for instance, an annular flange 20 acting as support for the air discharge nozzle 21, for instance, a spin nozzle, and a dirt catcher 22, also indicated by dot-dash lines and fastened to the annular flange 20 below the air discharge nozzle 21, for instance, by a rim bent around radially outwardly.

Figure 3:
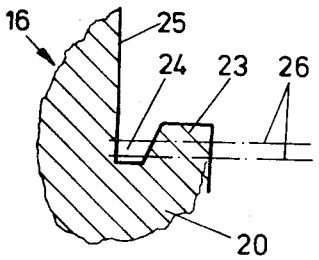
FIG. 3 is an enlarged, partial elevational view in section of the annular body in the area of the annular flange acting as a support for the air discharge nozzle and the dirt catcher.

Referring to FIG. 3, an upper part 23 of the annular flange 20 is separated from the cylindrical inside wall 25 of the annular body 16 by an annular groove 24. This annular groove 24 has an inside cross-section which flares trapezoidally inwardly and upwardly from the bottom of the groove. The upper part 23 of the annular flange 20 can be machined off mechanically to various elevations for the purpose of meeting tolerances, as indicated by the illustrative dash-dot lines 26. In this way, there is assurance that, regardless of minor fluctuations in the height of the compound panels, the air discharge nozzle 21 shall not project at its upper side beyond that of the panel, which would result in an undesirable tripping edge. Any required removal of the upper part 23 of the annular flange 20 by means of a lathe means or a grinding tool is facilitated by the annular groove 24. This annular groove 24 does prevent formation of any annular projections, for instance, on the cylindrical inside wall 25 that might then become support means for an erroneous air discharge nozzle emplacement.

Figure 4:
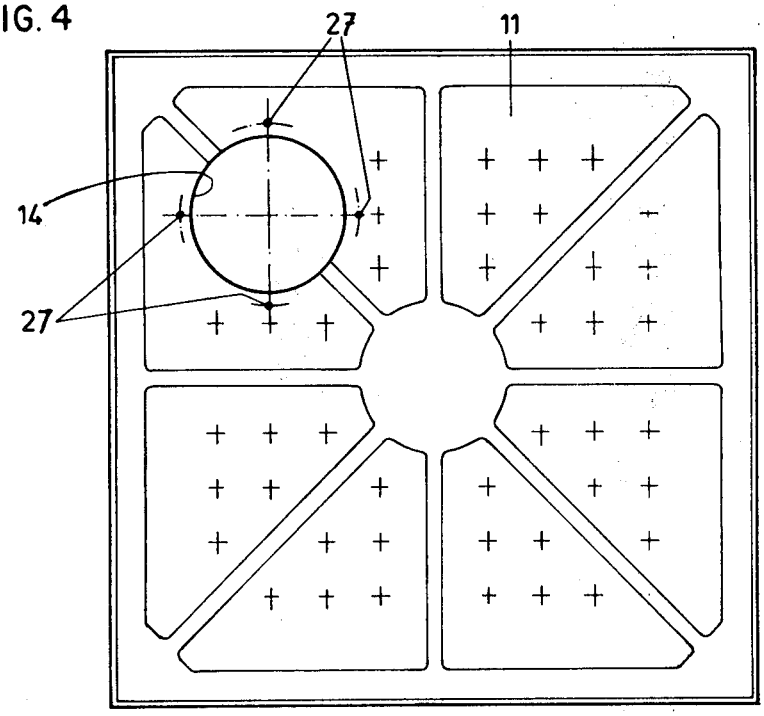
FIG. 4 is a bottom plan view of the tub-shaped sheathing of the compound panel, the panel containing an opening for seating the annular body of the invention.

FIG. 4 illustrates the bottom of the tub-shaped sheath 11 of the compound panel 10. In this case, it contains only one aperture 14 for seating an annular body 16. In the present embodiment, four holes 27 are provided around the aperture 14 into which can be mounted the sheet metal screws 18 which fasten the annular body 16.

Figure 5:
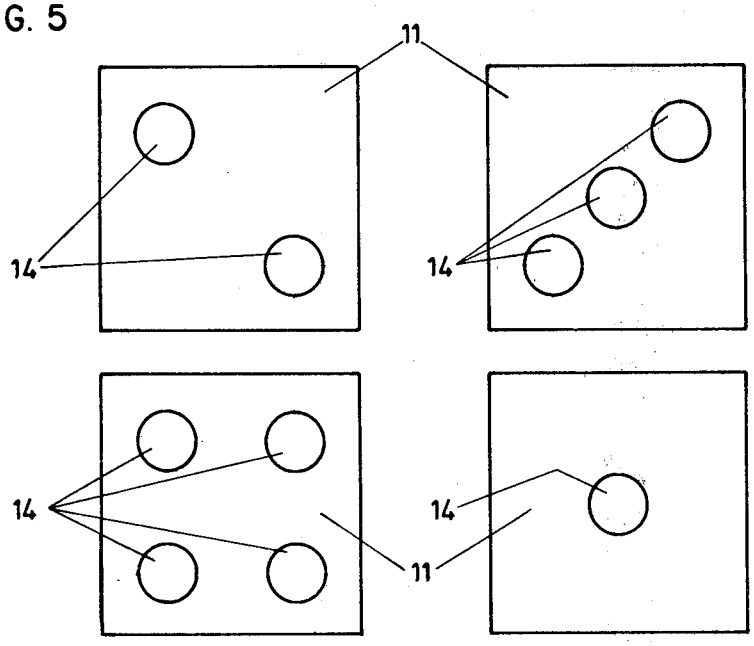
FIG. 5 illustrates in four schematic views the apertures for seating the annular body in the sheaths of the compound panel in various positions.

FIG. 5 illustrates schematically four sheaths 11 for compound panels, with apertures 14 for seating annular bodies 16 that may be present, for instance, in different numbers and arrangements. By using the annular body 16 and embedding it in the filler 12, i.e., fixing it to the bottom 13 of the sheath 11, the static parameters of the finished compound panels are assured to be practically the same as in another such panel without these apertures.

What is claimed is:

1. An overhanging compound construction panel for double floors used in room air conditioning, the panel having an external, tub-shaped sheathing means made of a high tensile-strength and high Young's modulus material, said sheathing means having an upper portion and a bottom with an aperture therein, and a filler means introduced in said tub-shaped sheathing means when in the flowing or pourable state and of a low tensile-strength and low Young's modulus, characterized by at least one rigid annular body (16) fixed in said aperture (14) to the bottom (13) of the tub-shaped sheathing means (11) in essentially hermetically sealing relation therewith and anchored in the filler means (12), said annular body (16) having a lower portion and extending up to the upper portion of the sheathing means and being provided with a radially inwardly projecting annular flange (20) at the lower portion thereof for supporting an air discharge nozzle (21) within said annular body and a dirt-catcher (22) beneath said nozzle (21), said annular body (16) comprising an inner wall (25), and said annular flange (20) having an upper portion (23) that is separated from said inner wall (25) by an annular groove (24).

2. The compound construction panel of claim 1, characterized in that said upper portion (23) has an outer surface which is tapered inwardly and upwardly.

3. The compound construction panel of claim 1, characterized in that the annular body (16) comprises at least one radially outwardly projecting annular flange (19) for anchoring it in the filler (12).

* * * * *